US006702027B2

(12) United States Patent
Olson et al.

(10) Patent No.: US 6,702,027 B2
(45) Date of Patent: Mar. 9, 2004

(54) GAS DISSIPATION CHAMBER FOR THROUGH TUBING CONVEYED ESP PUMPING SYSTEMS

(75) Inventors: David L. Olson, Los Alamitos, CA (US); Steven K. Tetzlaff, Huntington Beach, CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/023,676

(22) Filed: Dec. 18, 2001

(65) Prior Publication Data

US 2003/0111230 A1 Jun. 19, 2003

(51) Int. Cl.[7] ..... E21B 43/00

(52) U.S. Cl. ..... 166/369; 166/265; 417/360; 417/423.3

(58) Field of Search ..... 166/265, 105.5, 166/105.6, 369, 365, 242.6; 417/360, 423.2, 424.2; 55/406

(56) References Cited

U.S. PATENT DOCUMENTS 1,578,720 A * 3/1926 Derby ..... 166/105.5
2,190,104 A * 2/1940 McCoy ..... 166/105.5
2,525,233 A * 10/1950 Miller ..... 166/105.5
3,175,501 A * 3/1965 Carle ..... 415/169.1
4,366,861 A * 1/1983 Milam ..... 166/105.5
4,481,020 A * 11/1984 Lee et al. ..... 96/214
4,643,258 A * 2/1987 Kime ..... 166/369
4,900,433 A * 2/1990 Dean et al. ..... 210/170
5,207,810 A * 5/1993 Sheth ..... 55/406
5,516,360 A 5/1996 Normandeau et al. ..... 96/207
5,954,483 A 9/1999 Tetzlaff ..... 417/360
6,190,141 B1 * 2/2001 Henry ..... 417/423.3
6,193,474 B1 2/2001 Tetzlaff ..... 417/360
6,322,331 B1 * 11/2001 Swatek et al. ..... 417/360

* cited by examiner

*Primary Examiner*—David Bagnell
*Assistant Examiner*—Daniel P Stephenson
(74) *Attorney, Agent, or Firm*—Bracewell & Patterson, L.L.P.

(57) ABSTRACT

A gas dissipation chamber, installed between the tubing crossover and the production tubing string, for a through tubing conveyed ESP pumping system prevents gas discharged from the gas separator from entering the pump intake and subsequently gas locking the pumping system. The gas dissipation chamber secures to a lower end of production tubing. An electrical motor assembly is suspended on the lower end of the chamber. The gas separator and the pump are lowered through the tubing and land in the chamber in operative engagement with the motor assembly. Well fluid flows into the chamber to the separator, and gas separated by the separator vents out of the chamber into the casing. Liquid separated from the well fluid by the separator is pumped by the pump into the production tubing.

20 Claims, 3 Drawing Sheets

GAS DISSIPATION CHAMBER FOR THROUGH TUBING CONVEYED ESP PUMPING SYSTEMS

BACKGROUND OF THE INVENTION

1. Field of the Invention

This invention relates in general to electrically driven submersible well pumps, and in particular to a gas dissipation chamber for removing the gas processed by a through-tubing conveyed gas separator, thereby preventing such gas from entering the pump intake and gas locking the pump 2. Description of the Related Art Most oil wells being pumped by a downhole electrical pump typically will also produce some gas. If the gas is of sufficient volume, it can reduce the performance of the pump. In these circumstances, gas separators are mounted in the assembly below the pump to separate gas from the well fluid entering the intake of the pump.

Typically, prior art gas separators utilize a rotatably driven rotor within a cylindrical housing. The rotor has at least one blade and often an inducer vane. The blade will impart a centrifugal force to the well fluid flowing through the housing. This centrifugal force tends to separate the liquid components from the gas components because of difference in densities, with the liquid components locating near the outer wall of the housing, and the gas remaining near the shaft.

A discharge member, mounted above the rotor, provides a passage from the central portion of the rotor to the exterior of the gas separator to discharge gas. The discharge member also provides a liquid passageway for the remaining portion of the well fluid to flow upward toward the intake of a pump. In most systems the pump is suspended on and discharges into the production tubing. The separated gas flows up the annular space in the casing surrounding the tubing.

In other types of installations, the pump assembly is lowered into and suspended within the production tubing. Preferably the motor is mounted to the lower end of the production tubing, and the pump assembly stabs into engagement with the drive shaft of the motor. The pump discharges into the production tubing. If a through tubing gas separator is desired, it would be lowered along with the pump assembly through the tubing. In such case, there would be very little clearance around the gas separator and the pump for the separated gas to dissipate up the tubing. Therefore a gas bubble could be created around the intake, causing a gas lock.

SUMMARY OF THE INVENTION

A gas dissipation chamber for through tubing conveyed ESP (electrical submersible pump) pumping system prevents gas discharged from the gas separator from entering the pump intake and subsequently gas locking the pump system. The gas dissipation chamber is installed in the string of tubing between the tubing crossover to the motor and the production tubing string. The gas dissipation chamber is a tubular device having a series of slots and ports and is located above the seal section and motor. The pump and a gas separator are lowered through the tubing and land in the gas dissipation chamber.

The gas dissipation chamber has a larger inner diameter than the production tubing to provide an annular flow area above the gas separator. Lower ports on the gas dissipation chamber allow the well fluid to enter the gas separator, while the gas discharged from the gas separator will flow up the annular flow area and be vented out through upper slots in the chamber, thereby permitting principally liquid to enter the pump. The gas dissipation chamber shunts the discharged gas from the gas separator and the pump intake, thereby preventing the gas locking of the pump system.

DESCRIPTION OF THE PREFERRED EMBODIMENTS

Referring to FIGS. 1 and 2, a string of production tubing 1 extends from the surface into a cased well. Production tubing 1 is a conduit, typically made up of sections of pipe, for example four inches in diameter, screwed together. Production tubing 1 supports a submersible pump assembly.

Figure 1A:
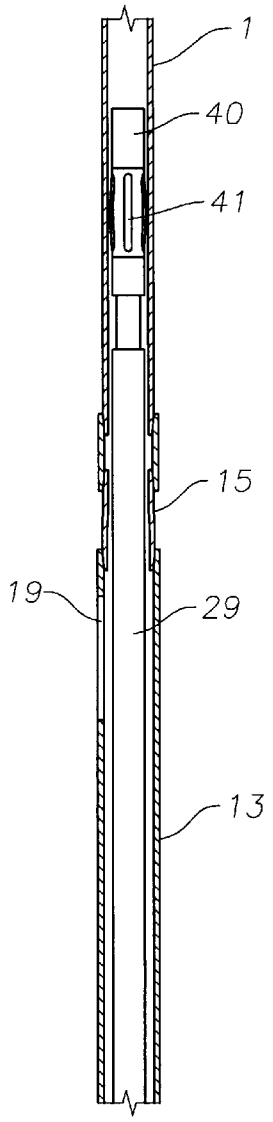
FIGS. 1A and 1B comprise a partially sectional view of an electrical submersible pump assembly and a gas dissipation chamber constructed in accordance with this invention.
Figure 1B:
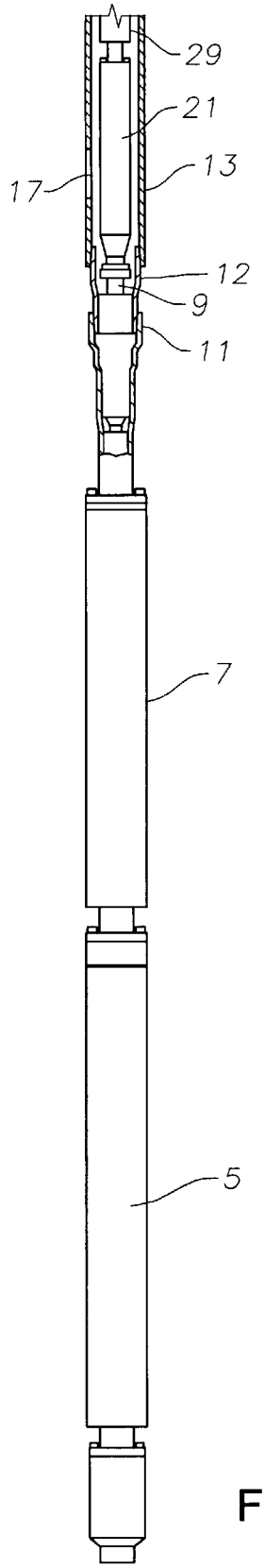
Figure 2A:
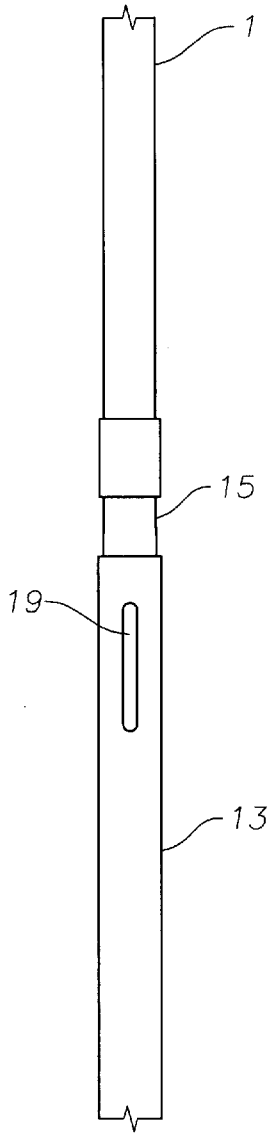
FIGS. 2A and 2B comprise a side elevational view of the submersible pump assembly and gas dissipation chamber of FIGS. 1A and 1B.
Figure 2B:
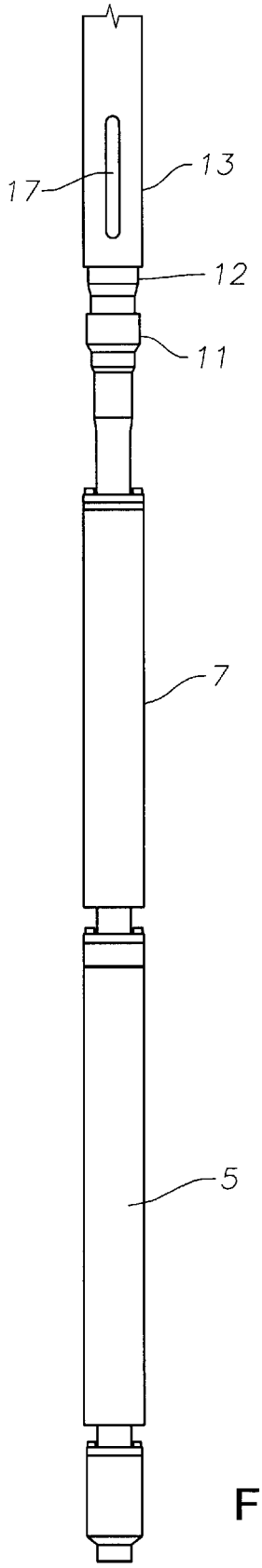

Referring to FIGS. 1B and 2B, the submersible pump assembly includes a motor 5 that is in this embodiment a three-phase A.C. electric motor. A power cable (not shown) connects to motor 5 and extends alongside tubing 1 to the surface for delivering power. Motor 5 is filled with a lubricant and coupled to a seal section 7, which seals well fluid from the interior of motor 5 and also equalizes pressure differential between lubricant in motor 5 and the exterior. Motors other than three-phase electrical motors are also feasible.

A multi-piece drive shaft 9 extends upward through seal section 7 and is driven by motor 5. Drive shaft 9 has a splined upper end that is rotatably supported within a tubular cross-over housing 11 by bushings. Cross-over housing 11 includes an adapter 12 with a threaded upper end. Adapter 12 may be integrally formed with cross-over housing 11 or secured by threads as shown.

A gas dissipation chamber 13 has a lower end secured to adapter 12. The upper end of gas dissipation chamber 13 is secured by an adapter 15 to production tubing 1. The weight of motor 5 and seal section 7 is thus supported by chamber 13. Referring to FIGS. 2A and 2B, chamber 13 has a set of lower ports or slots 17 located in its side wall near the lower end of chamber 13, and a set of upper ports or slots 19 located in the side wall near the upper end of chamber 13. Chamber 13 has a larger inner diameter than production tubing 1. Normally, however, the maximum outer diameters of the motor assembly comprising seal section 7 and motor 5 are greater than the inner diameter of chamber 13. Preferably, the maximum outer diameter of chamber 13 is approximately the same as the maximum outer diameters of seal section 7 and motor 5.

Figure 3:
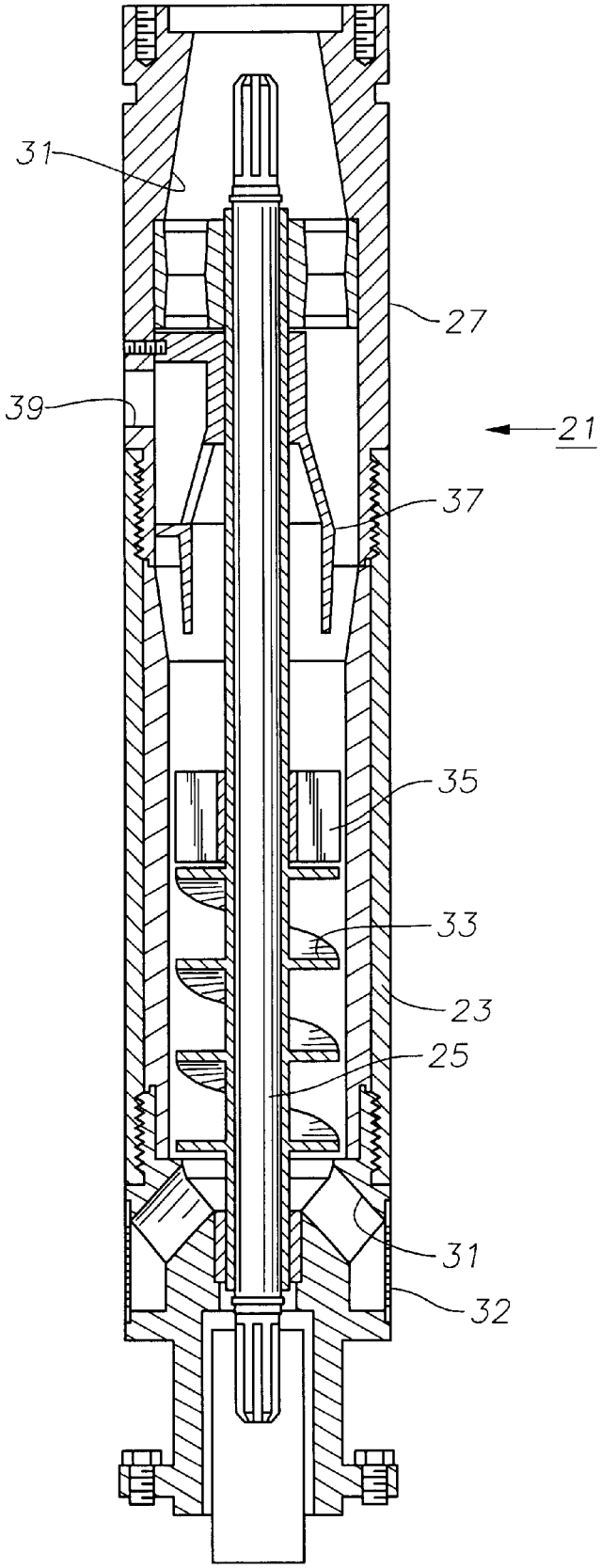
FIG. 3 is a cross-sectional view of the gas separator of the submersible pump assembly of FIGS. 1A and 1B.

Referring again to FIG. 1B, a gas separator 21 is located entirely within chamber 13. Gas separator 21 has an intake on its lower end for receiving well fluid flowing inward through lower ports 17. Gas separator 21 separates gas from the liquid of the well fluid and may be of different types. FIG. 3 illustrates one suitable type. Gas separator 21 has a tubular housing 23 through which a shaft 25 rotatably extends. An adapter (not shown) mounts to the lower end for making a stabbing engagement of shaft 25 with the splines of drive shaft 9. A head 27 secures to the upper end of housing 23 by threads. Head 27 is coupled to a lower end of a submersible pump 29 (FIGS. 1A and 2A). Head 27 has an axial discharge passage 31 for discharging liquid. into the intake of pump 29. The upper end of shaft 25 connects to a drive shaft contained in pump 29. A plurality of intake ports 31 are located at the lower end of separator housing 23. Intake ports 31 incline upward for drawing fluid into the lower end of housing 23. Optional screens 32 may be employed over inlet ports 31, if desired.

In this embodiment, an inducer 33 comprising a helical vane is mounted within separator housing 23 for rotation with shaft 25. A set of blades 35 are mounted above inducer 33 and rotate with shaft 25 for forcing heavier components of the well fluid outward due to centrifugal force. A cross-over 37 formed in head 27 collects the centrally located lighter components, such as gas, and directs them outward through a gas outlet port 39 in the side wall of housing 23. The heavier liquid components flow upward through axial passage 31 to the intake of pump 29 (FIGS. 1A and 2A).

In this embodiment, pump 29 is a centrifugal pump, having a plurality of stages of inducers and impellers, however, other types of pumps are also feasible. Pump 29 has a tubular adapter 40 (FIG. 1A) on its upper end that is adapted to be coupled by a running tool (not shown) to a line, such as coiled tubing or a cable, for lowering and retrieving pump 29 through tubing 1. Adapter 40 also has a seal 41 that is actuated by the running tool to seal adapter 29 to the interior of production tubing 1. Seal 41 thus seals the discharge end of pump 29 to the interior of tubing 1.

Gas dissipation chamber 13 encompasses gas separator 21 and preferably substantially the entire length of pump 29 so as to place upper ports 19 as far as practical from lower ports 19. This results in the gas being released into the casing a considerable distance from the intake of well fluid into chamber 13. In some cases, the distance between lower ports 17 and upper ports 19 may be 30 feet or more. However, it is not necessary that the entire length of pump 29 locate within chamber 13. The maximum outer diameter of gas separator 21 and pump 29 is smaller than the inner diameter of chamber 13 by a significant amount so as to create an annulus around gas separator 21 and pump 29 for gas discharged from gas outlet port 39 to flow upward. For example, the maximum outer diameter of gas separator 21 and pump 29 may be only about 2.7 inches, while the inner diameter of chamber 13 may be more than 4.5 inches. The lower ports 17 on the gas dissipation chamber 13 permit the well fluid and entrained gas to enter the gas separator 21. The upper ports 19 of the gas dissipation chamber 13 permit the gas discharged from the gas separator 21 to be vented out, thereby permitting substantially only liquid to enter the intake of pump 29.

In the operation, motor 5 and seal section 7 are secured to the lower end of chamber 13 by adapter 12. Chamber 13 is secured to the lower end of tubing 1 by adapter 15. Tubing 1 is then lowered into the well to a desired depth, while the power cable for motor 5 is strapped alongside tubing 1. Then pump 29 and gas separator 21 are lowered through tubing 1. The adapter on the lower end of gas separator 21 stabs separator drive shaft 25 into engagement with drive shaft 9. The running tool (not shown) and coiled tubing are detached from adapter 40 and retrieved to the surface.

When power is supplied, motor 5 will rotate drive shaft 9, which in turn will rotate shaft 25 of gas separator 21 and the drive shaft extending through pump 29. Pump 29 will draw fluid through intake ports 31 of gas separator 21. Gas separator 21 will proceed to separate the gas from the liquid and will vent the discharged gas from the gas separator 21 through outlets 39 into chamber 13. Gas separator 21 delivers the liquid directly into the lower end of pump 29. The discharged gas will travel up the annular space in chamber 13 around gas separator 21 and pump 29 and exit chamber 13 through upper ports 19. The separated liquid is discharged by pump 29 into tubing 1, where it flows to the surface. The gas discharged into the casing flows to the surface for gathering. There may be a packer between tubing 1 and the casing to isolate a hydrostatic head of well fluid in the casing from perforations in the casing. If so, passages with check valves may be provided in the packer to allow the upward flow of gas in the casing.

Periodically, the pump assembly comprising pump 29 and gas separator 21 may be retrieved through tubing 1 to the surface for repair or replacement. A running or retrieval tool is lowered through tubing 1 into engagement with adapter 40 for retrieving pump 29 and gas separator 21. Motor 5 and chamber 13 will remain downhole with tubing 1.

The invention has significant advantages. The discharge of the gas into the chamber and out the upper ports in the chamber prevents the discharged gas from forming into a gas bubble near the pump intake.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention maybe utilized independently, all as would be apparent to one skilled in the art after having the benefit of this description of the invention. Changes may be made in the elements described herein or in the steps or in the sequence of steps of the methods described herein without departing from the spirit and the scope of the invention as described.

What is claimed is:

1. A well pumping apparatus for producing well fluid through a production conduit suspended within casing in a well, the system comprising:

a chamber for securing to a lower end of the conduit, the chamber having an inlet for receiving well fluid from the casing;

a rotary pump having an upper end for discharging the well fluid into the conduit; a gas separator that separates gas from liquid in the well fluid, the gas separator having an upper end attached to a lower end of the pump and located within the chamber, the gas separator having an intake that receives well fluid from the chamber, a gas outlet that discharges gas separated from the well fluid into the chamber, and a liquid outlet that discharges liquid from the well fluid into the pump; and an outlet in the chamber above the inlet for discharging gas separated by the separator into the casing during production of the well fluid.

2. The apparatus of claim 1, wherein the chamber encloses the separator and the pump, and wherein the inlet of the chamber is located in a sidewall of the chamber.

3. The apparatus of claim 1, wherein the chamber encloses the separator and the pump and has an inner diameter larger than outer diameters of the gas separator and the pump to define an annular flow area for gas discharged from the gas separator to flow around the gas separator and the pump to the outlet of the chamber; and wherein the chamber has an open upper end through which the pump and the separator may be retrieved while the chamber remains stationarily secured to the lower end of the conduit.

4. The apparatus of claim 1, further comprising an electrical motor assembly in operable engagement with the gas separator and the pump for rotating the gas separator and the pump.

5. The apparatus of claim 1, further comprising an electrical motor assembly coupled to a lower end of the chamber, the electrical motor assembly having an outer diameter larger than an inner diameter of the chamber, the electrical motor assembly rotating an upward extending drive shaft that drives the gas separator and the pump.

6. The apparatus of claim 1, wherein:

the chamber has a cylindrical side wall;

the inlet of the chamber is located in the side wall near a lower end of the chamber, and the outlet of the chamber is located in the side wall near an upper end of the chamber.

7. The apparatus of claim 1, wherein:

the chamber has a cylindrical side wall that encloses the gas separator and the pump, the side wall having a larger inner diameter than the gas separator and the pump, defining an annular flow area between the side wall and the gas separator and the pump;

the inlet of the chamber is located in the side wall near a lower end of the chamber, and the outlet of the chamber is located in the side wall near an upper end of the chamber, and wherein the apparatus further comprises:

an electrical motor assembly coupled to a lower end of the chamber, the electrical motor assembly having an outer diameter larger than an inner diameter of the side wall of the chamber, the electrical motor assembly rotating an upward extending drive shaft that drives the gas separator and the pump.

8. A well pumping apparatus, comprising:

a production conduit suspended within casing in a well;

a chamber coupled to a lower end of the conduit, the chamber having an inlet for receiving well fluid from the casing, the chamber having an inner diameter that is greater than an inner diameter of the production conduit;

an electrical motor assembly coupled to a lower end of the chamber, the electrical motor assembly having an upward extending drive shaft and an outer diameter that is greater than an inner diameter of the chamber;

a rotary pump having an upper end that discharges well fluid into the interior of the production conduit;

a rotary gas separator that separates gas from liquid in the well fluid, the gas separator being attached to a lower end of the pump, the gas separator and the pump being retrieved and lowered through the conduit into the chamber in stabbing engagement with the drive shaft of the motor, the gas separator having an intake that receives well fluid from the chamber, a gas outlet that discharges gas separated from the well fluid into the chamber, and a liquid outlet that discharges liquid from the well fluid into the lower end of the pump;

an annular flow area between the inner diameter of the chamber and an outer diameter of the gas separator for the passage of gas discharged by the separator; and an outlet in the chamber above the inlet for discharging gas flowing up the annular flow area into the casing during production of the well fluid.

9. The apparatus according to claim 8, wherein:

the chamber has a cylindrical side wall;

the inlet of the chamber is located in the side wall near the lower end of the chamber; and the outlet of the chamber is located in the side wall near an upper end of the chamber.

10. The apparatus according to claim 8, further comprising:

an adapter on the upper end of the pump for lowering and retrieving the pump through the conduit, the adapter sealingly engaging the inner diameter of the conduit.

11. The apparatus according to claim 8, wherein the chamber encloses the gas separator and the pump.

12. A method for producing a well, comprising:

(a) securing a chamber to a production conduit, and suspending the production conduit within casing in a well;

(b) securing a gas separator to a pump, lowering the gas separator and the pump through the production conduit, and landing the gas separator in the chamber;

(c) operating the pump to cause well fluid to flow into the chamber and into the gas separator;

(d) separating gas from liquid in the well fluid with the gas separator;

(e) discharging gas separated from the well fluid by the gas separator into the chamber, flowing the gas up the chamber alongside the gas separator, and discharging the gas from the chamber into the casing, and (f) discharging liquid separated by the gas separator from the well fluid into the pump, pumping the liquid with the pump, and discharging the liquid from the pump into the production conduit.

13. The method according to claim 12, wherein step (a) comprises providing the chamber with a greater length than the gas separator.

14. The method according to claim 12, wherein step (a) comprises providing the chamber with an inner diameter greater than an inner diameter of the production conduit.

15. The method according to claim 12, further comprising:

coupling an electrical motor assembly to a lower end of the chamber; wherein step (a) comprises lowering the motor assembly into the well along with the production conduit;

step (b) comprises stabbing a lower end of the gas separator into operative engagement with the motor assembly while landing the gas separator in the chamber; and step (c) comprises rotating the pump with the motor assembly.

16. The method according to claim 12, wherein step (b) comprises sealing an upper end of the pump within the production conduit.

17. The method according to claim 12, wherein step (b) comprises landing substantially the entire length of the pump in the chamber.

18. The method according to claim 12, further comprising:

coupling an electrical motor assembly to a lower end of the chamber, the electrical motor assembly having a maximum outer diameter greater than an inner diameter of the chamber, and the chamber having a greater inner diameter than an inner diameter of the production conduit; wherein step (a) comprises lowering the motor assembly into the well along with the production conduit;

step (b) comprises stabbing a lower end of the gas separator into operative engagement with the motor assembly while landing the gas separator in the chamber; and step (c) comprises driving the gas separator and the pump with the motor assembly.

19. The method according to claim 18, wherein step (a) comprises providing the chamber with an outer diameter substantially the same as a maximum outer diameter of the motor assembly.

20. A method for producing a well, comprising:

(a) securing a chamber to a production conduit, the chamber having a greater inner diameter than the production conduit, the chamber having a side wall with an inlet near a lower end of the chamber and an outlet near an upper end of the chamber;

(b) coupling an electrical motor assembly to a lower end of the chamber, the motor assembly having an outer diameter larger than the inner diameter of the chamber, and having an upward extending drive shaft; then (c) lowering and suspending the production conduit within casing in a well; then (d) securing a rotary gas separator to a rotary pump, lowering the gas separator and the pump through the production conduit, and landing the gas separator in the chamber with a drive shaft of the gas separator making a stabbing engagement with the drive shaft of the motor assembly; then (e) rotating the pump and the gas separator to cause well fluid to flow into the inlet of the chamber and into the gas separator;

(f) separating gas from liquid in the well fluid with the gas separator, discharging gas separated from the well fluid by the gas separator into the chamber, flowing the gas up the chamber alongside the gas separator, and discharging the gas from the outlet of the chamber into the casing, and (g) discharging liquid separated by the separator from the well fluid into the pump, pumping the liquid with the pump, and discharging the liquid from the pump into the production conduit.

* * * * *